US006471775B1

(12) United States Patent
Becker et al.

(10) Patent No.: US 6,471,775 B1
(45) Date of Patent: Oct. 29, 2002

(54) SLIT NOZZLE FOR COATING TRIPS OF MATERIAL, ESPECIALLY PAPER OR BOARD STRIPS, WITH A PIGMENT COATING

(75) Inventors: Ingo Becker, Köln; Reinhard Knop, Essen; Bernd Bohnenkamp, Düsseldorf, all of (DE)

(73) Assignee: Jagenberg Papiertechnik GmbH, Neuss (DE)

( * ) Notice: Subject to any disclaimer, the term of this patent is extended or adjusted under 35 U.S.C. 154(b) by 0 days.

(21) Appl. No.: 09/581,694

(22) PCT Filed: Oct. 17, 1998

(86) PCT No.: PCT/EP98/06587

§ 371 (c)(1),
(2), (4) Date: Jul. 17, 2000

(87) PCT Pub. No.: WO99/31321

PCT Pub. Date: Jun. 24, 1999

(30) Foreign Application Priority Data

Dec. 15, 1997 (DE) ..... 197 55 625

(51) Int. Cl.[7] ..... B05C 5/02; B05B 1/14

(52) U.S. Cl. ..... 118/325; 118/411; 118/DIG. 4; 239/597; 239/568; 239/566

(58) Field of Search ..... 118/235, 411, 118/DIG. 4; 239/568, 566, 601, 597, 518, 521, 451, 455, 456, 422

(56) References Cited

U.S. PATENT DOCUMENTS

| | | | | | |
|---|---|---|---|---|---|
| 3,632,374 | A | * | 1/1972 | Greiller | 118/324 |
| 4,041,598 | A | * | 8/1977 | D'Angelo et al. | 29/432 |
| 4,756,271 | A | * | 7/1988 | Maier | 118/411 |
| 4,765,272 | A | * | 8/1988 | Mladota | 118/410 |
| 4,944,960 | A | * | 7/1990 | Sundholm et al. | 118/325 |
| 5,843,230 | A | * | 12/1998 | Potjer et al. | 118/407 |

FOREIGN PATENT DOCUMENTS

| | | |
|---|---|---|
| DE | 296 10 773 U1 | 10/1996 |
| EP | 0 327 020 B1 | 8/1989 |
| EP | 0 517 223 B1 | 12/1992 |
| EP | 0 536 649 A1 | 4/1993 |
| EP | 0 761 877 A2 | 3/1997 |

* cited by examiner

*Primary Examiner*—Richard Crispino
*Assistant Examiner*—Yewebdar T Tadesse
(74) *Attorney, Agent, or Firm*—Herbert Dubno

(57) ABSTRACT

A slot nozzle for coating webs of material, for example, paper, paperboard, cardboard, with a flowable coating substance, for example, a pigment coating, has a slot shaped outlet channel to which a distribution chamber extending over the width of the web is connected. A plurality of supply conduits are connected to the distribution chamber in spaced relationship across the width of the web and the length of the outlet channel and each supply conduit has a valve for adjusting the volume flow of the coating liquid. A respective diffuser is provided between each supply conduit and the distribution chamber and widens in the direction of the latter.

14 Claims, 7 Drawing Sheets

SLIT NOZZLE FOR COATING TRIPS OF MATERIAL, ESPECIALLY PAPER OR BOARD STRIPS, WITH A PIGMENT COATING

CROSS REFERENCE TO RELATED APPLICATIONS

This application is a national stage of PCT/EP95/106597 filed Oct. 17, 1998 and based upon German application 197 55 625.6 of Dec. 15, 1997 under the International Convention.

1. Technical Field

The invention relates to a slot nozzle for coating webs of material, particularly paper or cardboard webs with a pigment coating, having a slot-shaped outlet channel extending over the work width and a distribution chamber extending over the work width, to which the outlet channel is connected.

2. State of the Art

For the coating webs of material, slot nozzles extending over the work width are known for applying to the web of material a defined curtain or jet of coating material. In coating devices which work according to the principle of curtain coating (English: curtain coater), the slot nozzle is arranged above the web extending transversely to the travel direction of the web. The coating material exits the nozzle as a free-falling curtain and falls onto the web. Such a slot nozzle of the generic kind is known from a coating device described in EP 0 327 020-B1, which serves for the production of photographic film. A method of producing coated paper, whereby the pigment coating is applied in a free-falling curtain to a paper web, is known from EP 0 517 223-B1.

In so-called free jet nozzle applicators the slot nozzle is formed by two lips, from which a free jet of coating material under pressure is directed against the web or—in indirect application—against a roller. The use of a slot nozzle as a free jet nozzle for coating paper webs is described in DE 296 10 773-U.

DESCRIPTION OF THE INVENTION

In the coating of paper or cardboard webs of large width (for instance 10 m) it is required to produce over the work width a very uniform jet or curtain of coating material. This is particularly hard to achieve when small amounts of pigment coating (for instance 10 ml/m$^2$) have to be applied. Pigment coatings are tend to demix if different shearing conditions exist in the flow. At the same time no disturbing deposits of pigment can be permitted in the supply channels and in the nozzle.

Therefore it is the object of the invention to improve a generic slot nozzle so that it is capable to apply on very wide paper or cardboard webs also small amounts of pigment evenly and free of disturbances over the work width, under variable conditions, e.g. variable viscosity or changing application amounts.

The slot nozzle for coating paper or cardboard webs with a pigment coating, comprises a slot-shaped outlet channel extending over the work width, to which the outlet channel is connected. According to the invention, the distribution chamber is connected to at least two supply channels each having a device for adjusting the supplied volume flow of coating material.

The slot nozzle of the invention offers the possibility to influence the flow conditions in the distribution chamber over the work width and the supplied volume flow.

Preferably, the supply channels are arranged on the side opposite to the outlet channel and the connection distance between two supply channels amounts to 100 mm to 1500 mm, preferably 500 mm to 800 mm.

At a distance of 100 mm to 1500 mm between two supply channels, preferably 500 mm to 800 mm, it is insured that the part of the distribution chamber supplied with coating material by a supply channel is not too large, so that during the cross distribution in the chamber no unacceptable flow differences occur.

Designing the connection between a supply channel and the distribution chamber as a diffuser causes a substantial reduction of the flow velocity when entering the distribution chamber. This prevents a detachment of the coating from the walls and thereby the formation of vortices, which would lead to irregular flow conditions.

Diffusers connected at an angle to the distribution chamber make it possible to use long diffusers when the overall dimensions are small, and to connect the same to supply channels coming substantially straight from one side. Since inside the supply channels the coating is transported at high velocity, in the case of sensitive coatings bent segments in the supply channel could result in undesired separation effects in the mixture.

The bordering wall of the diffuser can be connected to the distribution chamber at an angle $\alpha$ between 0° and 90°, preferably between 30° and 60°, and the opposite bordering wall at an angle $\beta$ between 10° and 45°. In each supply channel a hose clamp valve can be integrated for the adjustment of the volume flow. Preferably, one or both longitudinal walls of the nozzle body a row of heating or cooling elements is arranged. The slot nozzle itself can be arranged in a climatic chamber.

The nozzle body can be composed of two parts, each having a surface-ground inner surface, whereby in one part the distribution chamber is worked in as a groove and that during joining in the area above the distribution chamber a flat material is inserted, which keeps the area below the distribution chamber at the desired distance, in order to form the outlet channel.

According to the invention, coating paint is applied to the web in a free- falling curtain. The outlet channel of the slot nozzle can have a slot width of 150 $\mu$m to 600 $\mu$m, preferably 250 $\mu$m to 350 $\mu$m. The distribution chamber can have a height measured parallel to the outlet channel of 10 mm to 100 mm, preferably 20 mm to 60 mm.

The outlet channel of the slot nozzle can have a slot width of 700 $\mu$m to 1300 $\mu$m. The distribution chamber can have a height measured parallel to the outlet channel of 40 mm to 150 mm.

BRIEF DESCRIPTION OF THE DRAWING

The drawing serves for explaining the invention by examples illustrated in a simplified manner. In the drawing.

SPECIFIC DESCRIPTION

The nozzles shown in the Figures serves for the application of pigment coating on a paper or cardboard web B. The pigment coating is applied either directly onto the paper or cardboard web B or first onto a roller which subsequently transfers a film of pigment coating to the web B.

The slot nozzle is used either as a curtain-producing nozzle or a free jet nozzle. When used as a curtain-producing nozzle it is arranged above the web B extending across the work width and the pigment coating exits the nozzle in a free-falling curtain V. The various possibilities of arranging a slot nozzle as a curtain-producing nozzle within a coating device for coating paper or cardboard webs with pigment coating and their modus operandi is described in detail in German Patent Application 197 16 647.4, to which specific reference is made.

When used as a free jet nozzle, a free jet S of pigment coating under pressure exits the slot nozzle and is directed towards the web B or—as in the indirect application—towards a roller. Normally the free jet nozzle is arranged in relation to the web B to be coated or the tangent to the roller to be coated, so that the liquid jet S hits the web B or the roller at an acute angle to the travel direction. The use of a free jet nozzle in a device for coating paper or cardboard webs with pigment coating is described in detail in German Patent Application 197 19 128, to which specific reference is made.

In the embodiment shown in FIGS. 1 to 5, the nozzle body consists of two wall-shaped parts 1, 2 with a length corresponding to the desired work width. In one longitudinal side of one part (in the Example part 1), a longitudinal groove is made, which after the two parts 1, 2 are joined forms a distribution chamber 3. The two parts 1, 2 have each surface ground inner surfaces, with which they can be joined and kept together by fastening screws 4.

Figure 1:
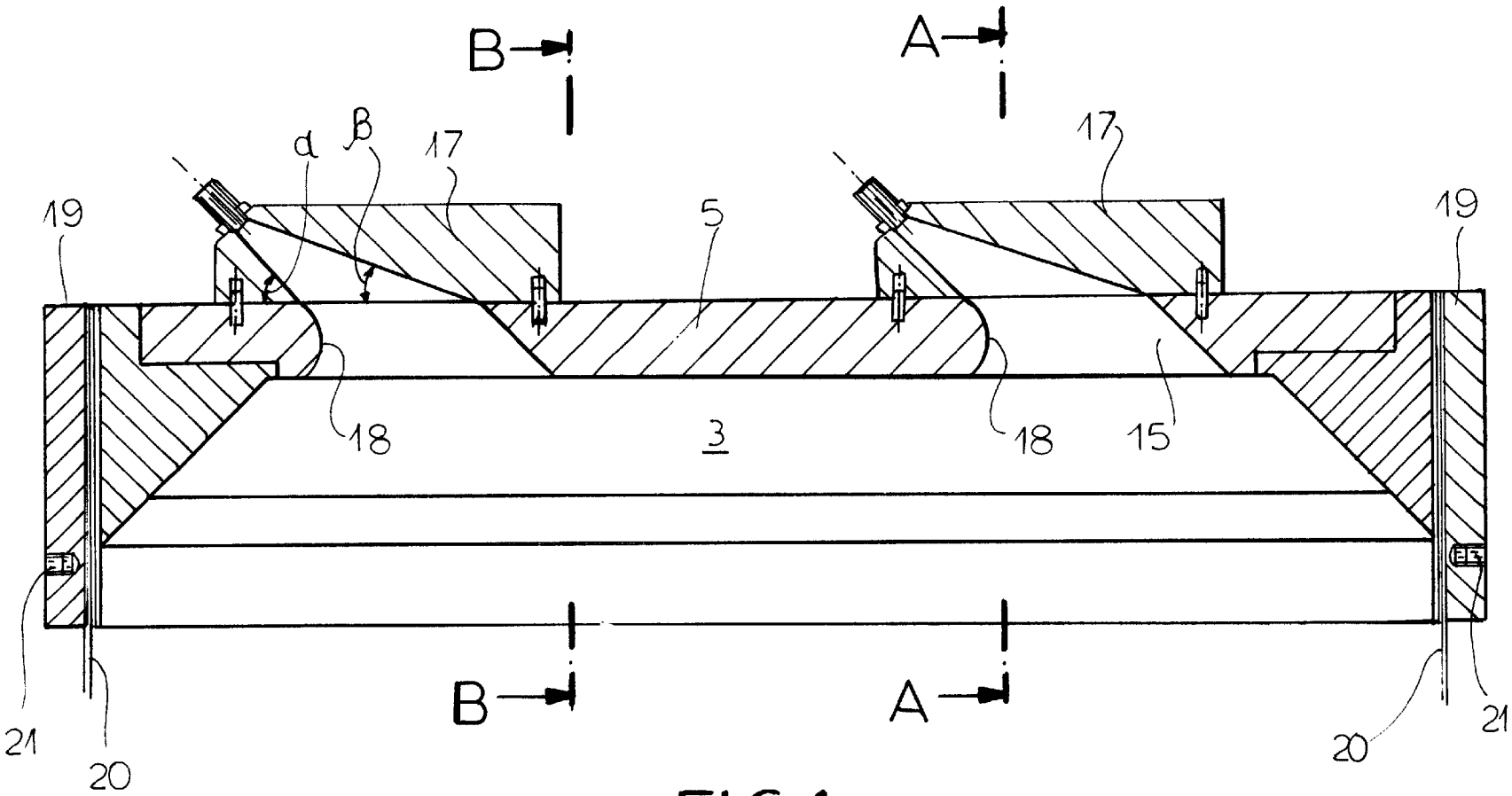
FIG. 1 is a longitudinal section through a slot nozzle of the invention.
Figure 2:
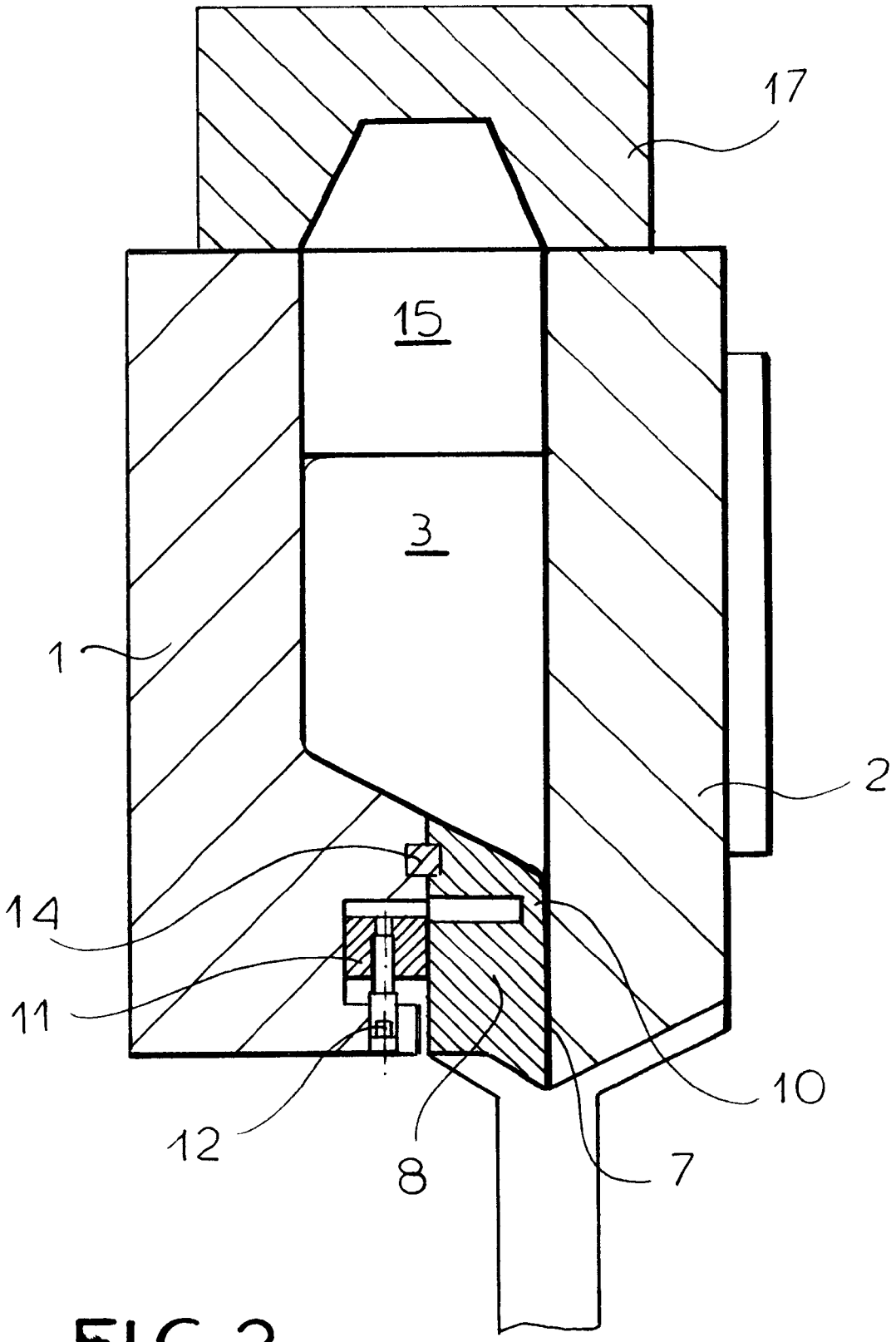
FIG. 2 is a cross section along line A—A of FIG. 1.
Figure 3:
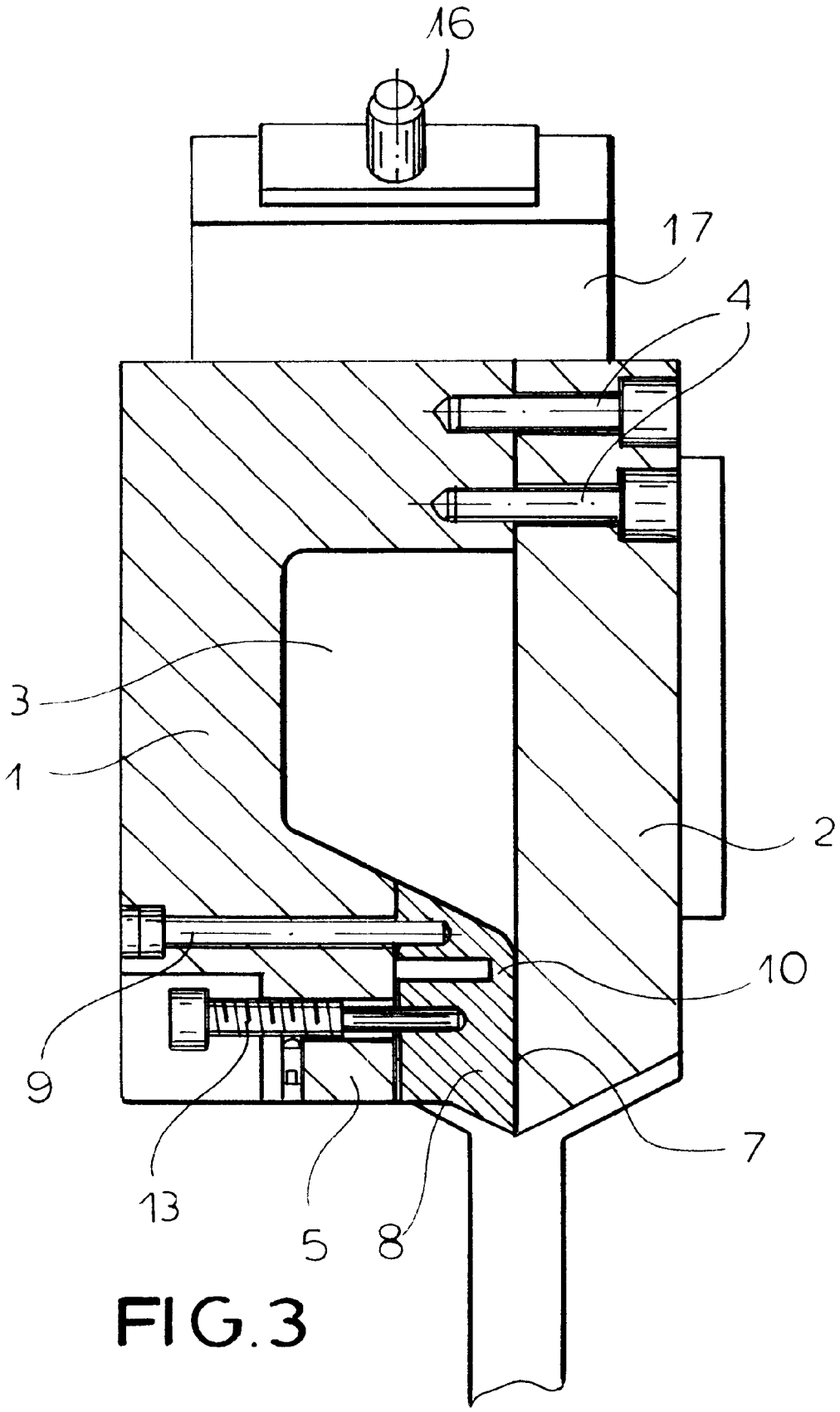
FIG. 3 is a cross section along line B—B of FIG. 1.
Figure 4:
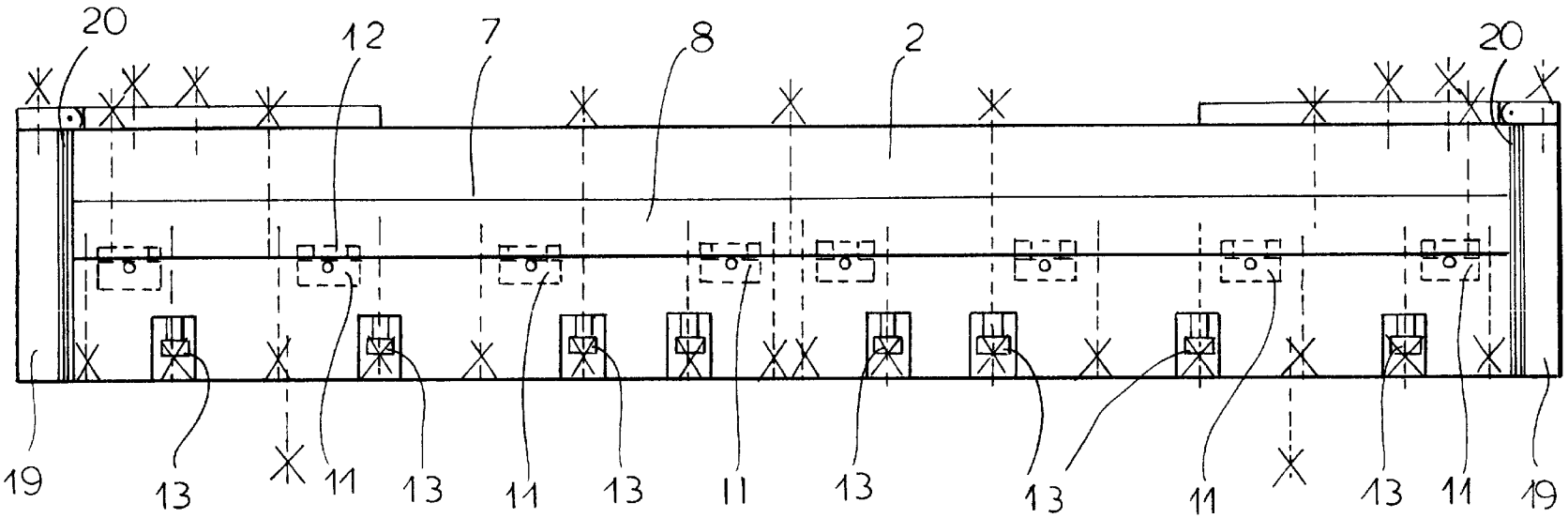
FIG. 4 is a plan view from below of the exit slot.

One of the two transverse wall defining the distribution chamber—in FIGS. 2 and 3 the lower transverse wall 5—has a slightly shorter height than the other, upper transverse wall 6, so that when the parts are joined a distance to the wall part 2 remains, in order to form in this area a slot-shaped outlet channel 7 extending over the work width, which is connected to the distribution chamber 3 and from which the pigment coating exits. In order to be able to adjust the slot width of the outlet channel 7 in individual areas over the work width, the outlet channel 7 is bordered on the one side by the inner surface of the wall part 2, and on the other side by an inset bar 8, which is fastened on the inner surface of the lower transverse wall 5 by means of screws 9. Underneath the fastening screw 9, on its side facing away from the outlet channel 7, the inset bar 8 has a longitudinal slot, so that a weak point 10 results, around which its lower part can be bent for the adjustment of the slot width. The lower part of the inset bar 8 has the distance from the inner surface of the transverse wall 5 required for the adjustment path. The setting of the slot width of outlet channel 7 takes place by means of wedges 11 arranged at regular distances over the work width, which are arranged movable in a longitudinal groove of the lower transverse wall 5 parallel to the outlet channel 7, and which support the inset bar 8 on its rear side. This way the wedges 11 determine in their area the distance of the inset bar 8 from the wall part 2 and thereby the slot width of the outlet channel 7. The setting of the position of each wedge 11 takes place by means of an adjusting screw 12. In order to fix the position of the inset bar 8 to each wedge 11, in the area between the two wedges 11 clamping screws 13 are arranged, by means of which the inset bar 8 can be clamped securely against the wedges 11 and thereby against the transverse wall 5. Keys 14 between the transverse wall 5 and the upper area of the inset bar 8 prevent a displacement of the inset bar 8 parallel to the outlet channel 7 during the setting of the slot width. Preferably the inner surfaces of the transverse wall 5 and the inset bar 8, which form the lower bordering wall of the distribution chamber 3, are in true alignment with respect to each other and inclined in the direction of the outlet channel 7, so that the coating paint is guided towards the outlet channel 7. When used as a curtain-producing nozzle, the width of the outlet channel 7 is set to a value between 150 $\mu$m and 600 $\mu$m, preferably between 250 $\mu$m and 350 $\mu$m. When used as a free jet nozzle, the width of the outlet channel 7 ranges between 700 $\mu$m and 1300 $\mu$m.

As a curtain-producing nozzle the height measured parallel to the outlet channel 7 ranges between 20 mm and 60 mm. If the height is more than 20 mm, then its width is smaller than the height. As free jet nozzle the height of the distribution chamber 3 ranges between 40 mm and 150 mm. Preferably the width amounts to between 50% and 60% of the height.

Figure 5:
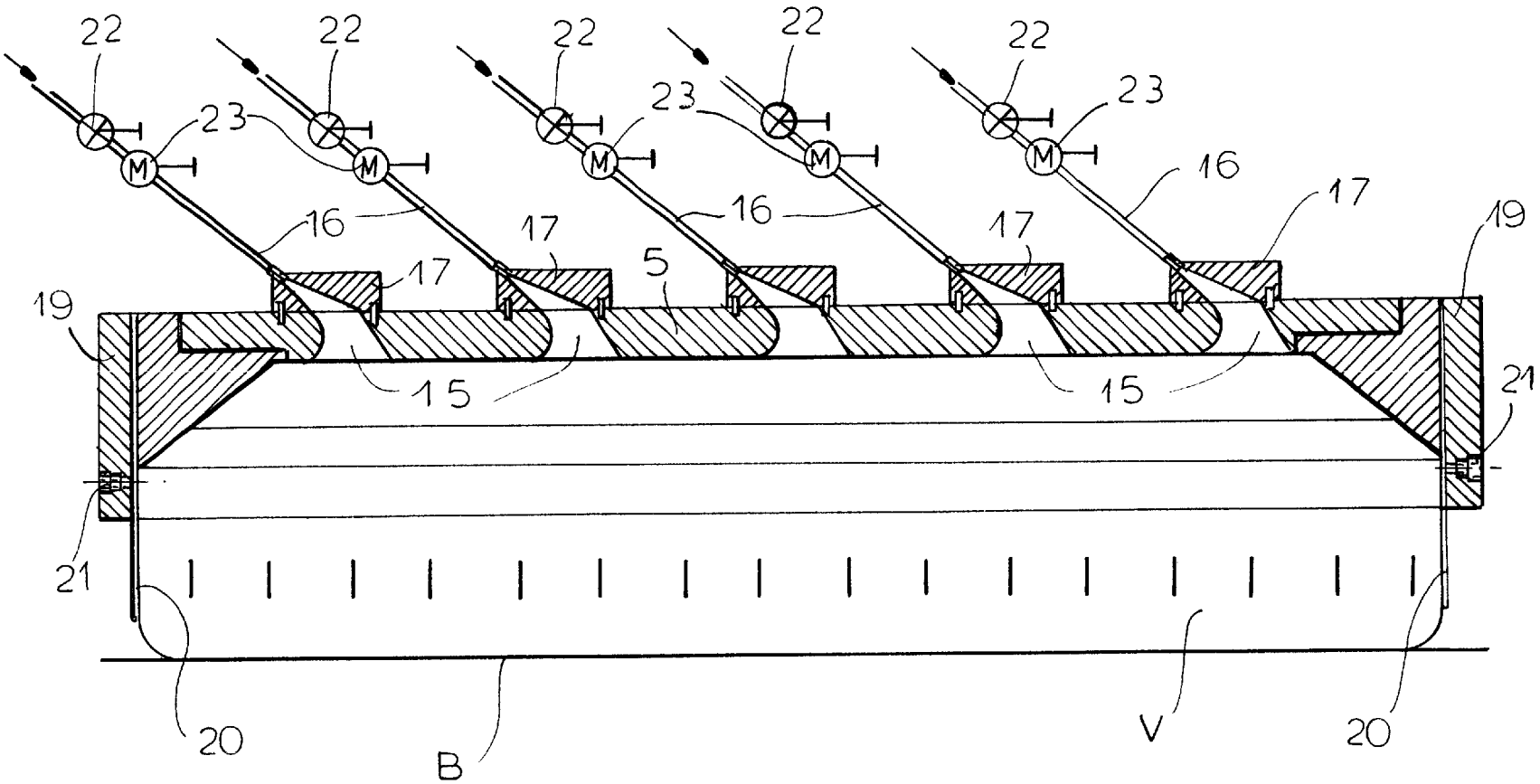
FIG. 5 is a cross sectional view which shows the construction and modus operandi of a slot nozzle used as a curtain nozzle.

The upper transverse wall 6 of part 1 has at regular distances inlet openings 15, to which—as shown in FIG. 5—supply channels 16 are connected for the supply of coating paint to the distribution chamber 3. The supply channels 16, connected this way to the side of the distribution chamber 3 which is opposite to the outlet channel 7, are connected at a distance between 100 mm and 1500 mm, preferably between 500 mm and 800 mm. Preferably the connection of each supply channel 16 to the distribution chamber 3 is designed as a diffuser, so that because of the increasing flow cross section the flow velocity decreases when entering the distribution chamber 3. The diffusers are each formed by the opening 15 in the transverse wall 5 and diffuser part 17 screwed thereon, on which each supply channel 16 is fastened.

Preferably the diffusers formed by the openings 15 and the diffuser part 17 are built and arranged in such a manner that they are connected to the distribution chamber 3 towards the lateral border and inclines with respect to the vertical. The connection of the diffusers preferably inclines to one side—i.e. with parallel supply channels 16—takes place so that one bordering wall (in FIG. 1 the left bordering wall) is connected to the upper bordering wall of the distribution chamber 3 at an angle $\alpha$ between 0° and 90°, preferably between 30° and 60°, the opposite wall of the diffuser at an angle $\beta$ between 10° and 45°. Further the bordering wall of the diffuser is in addition bent outwards directly before the connection to the distribution chamber 3, in order to further increase the cross section and to keep the radius of deflection as large as possible. In the embodiment example this is done through a corresponding bend in the last portion of the wall 18 on the incoming side of the inlet opening 15. This configuration of the bordering wall 18 of the diffuser prevents a detachment of the coating paint from the walls, and thereby the formation of vortexes, which would cause a demixing of the coating paint.

At its ends, the slot nozzle is closed by lateral plates 19. When used as a curtain-producing nozzle, on each side immediately next to the outlet channel 7 a downwards extending guide element 20 is arranged, which acts against a constriction of the coating paint curtain V falling from the outlet channel 7. In order to prevent the coating paint from tearing off the guide element 20, a partial flow of the coating paint is allowed to run down on the inner surface of each guide element 20 as a contact fluid, which is supplied via a supply channel 21.

As shown in FIG. 5, each supply channel 16 has a device 22 for setting the volume flow. In order to avoid pigment deposits in the device 22, preferably hose clamp valves are used for the setting of the volume flow. Alternatively also diaphragm valves can be used. In addition each supply channel has a measuring device 23 for determining the actual volume flow, so that the same can be individually adjusted; e.g. inductive or ultra sound devices 23 for measuring the volume flow.

Figure 6:
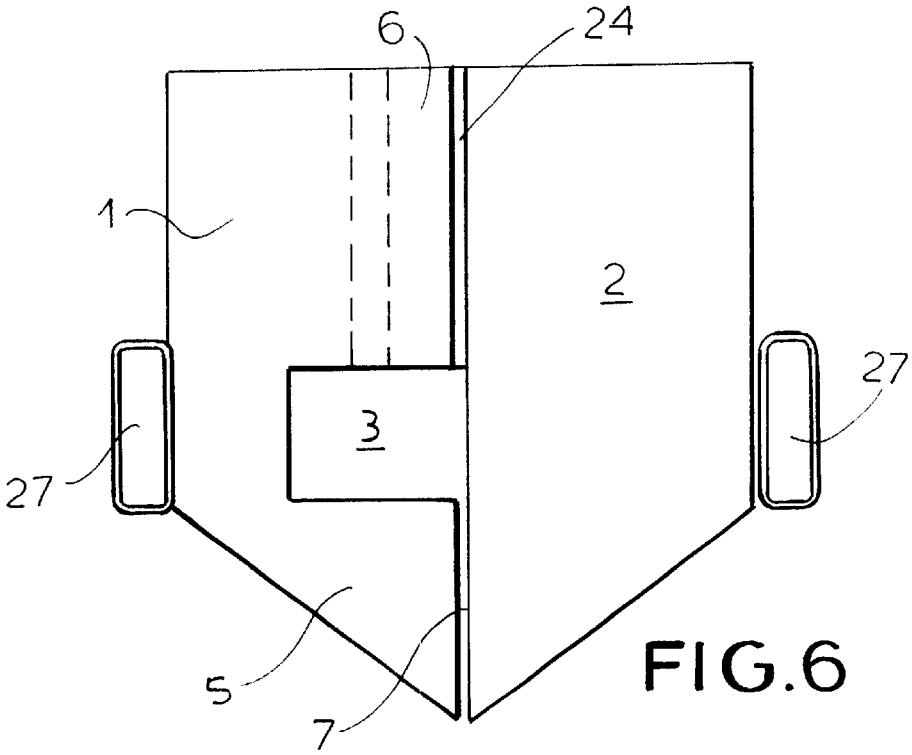
FIG. 6 is a rough diagram of a particularly simple construction of a slot nozzle with cooling elements on the longitudinal sides.

FIG. 6 shows schematically an embodiment of a nozzle with a particularly simple construction. This construction is appropriated in cases when no setting elements for the adjustment of the cross section are necessary, i.e. the width of the outlet channel 7 does not have to be individually adjustable over the work width.

As in the embodiment according to FIGS. 1 to 4, the nozzle body is composed of two parts 1, 2, each having a surface-ground inner surface. In one part—the left part 1 in FIG. 6—the distribution chamber 3 is worked in as a longitudinal groove. Different than in the embodiment of FIGS. 1 to 4, the inner surfaces of the two transverse walls 5, 6 are in true alignment. During joining in the area above the distribution chamber 3 a flat material 24, e.g. a foil, is inserted, whose thickness corresponds with the desired slot width of the outlet channel 7. So during the joining of the two parts 1, 2, in the area below the distribution chamber 3, the lower transverse wall is kept at a distance from the inner surface of part 2 corresponding to the thickness of the flat material 24. The outlet channel 7 with the desired slot width is formed.

Figure 7:
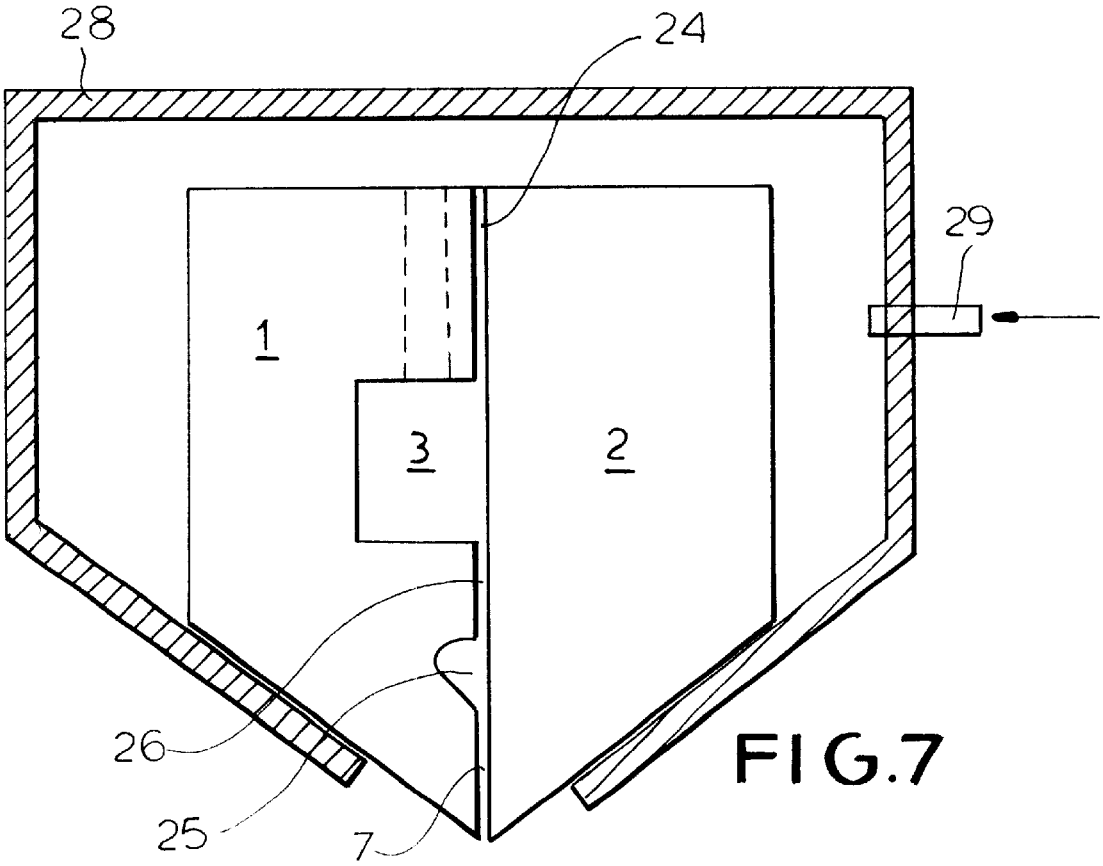
FIG. 7 is in a rough diagram of the cross section of a slot nozzle with a second distribution chamber, which is arranged in a climatic chamber.

FIG. 7 shows an embodiment with a second distribution chamber 25 arranged between the first distribution chamber 3 and the outlet channel 7. Between the first distribution chamber 3 and the second distribution chamber 25 there is an additional flow channel 26, which causes a further uniformization of the flow.

In the case of large work widths, locally different temperatures lead to deformations which influence the outlet channel 7. In order to act against these deformations, on one or both lateral walls of the nozzle body of the slot nozzle a row of heating or cooling elements 27 are arranged, as shown in FIG. 6. The heating or cooling elements 27, for instance Peltier elements or resistance wires, etc. are arranged over the work width at a distance of 100 mm and more, their heating or cooling action can be individually adjusted, in order to target individual areas. Alternately or additionally it is possible to arrange the entire slot nozzle in a climatic chamber 28, as shown in FIG. 7. A temperature-adjusted medium, for instance water or air, is fed into the climatic chamber through a supply line 29, in order to keep the temperature in the nozzle at a desired constant value.

Figure 8:
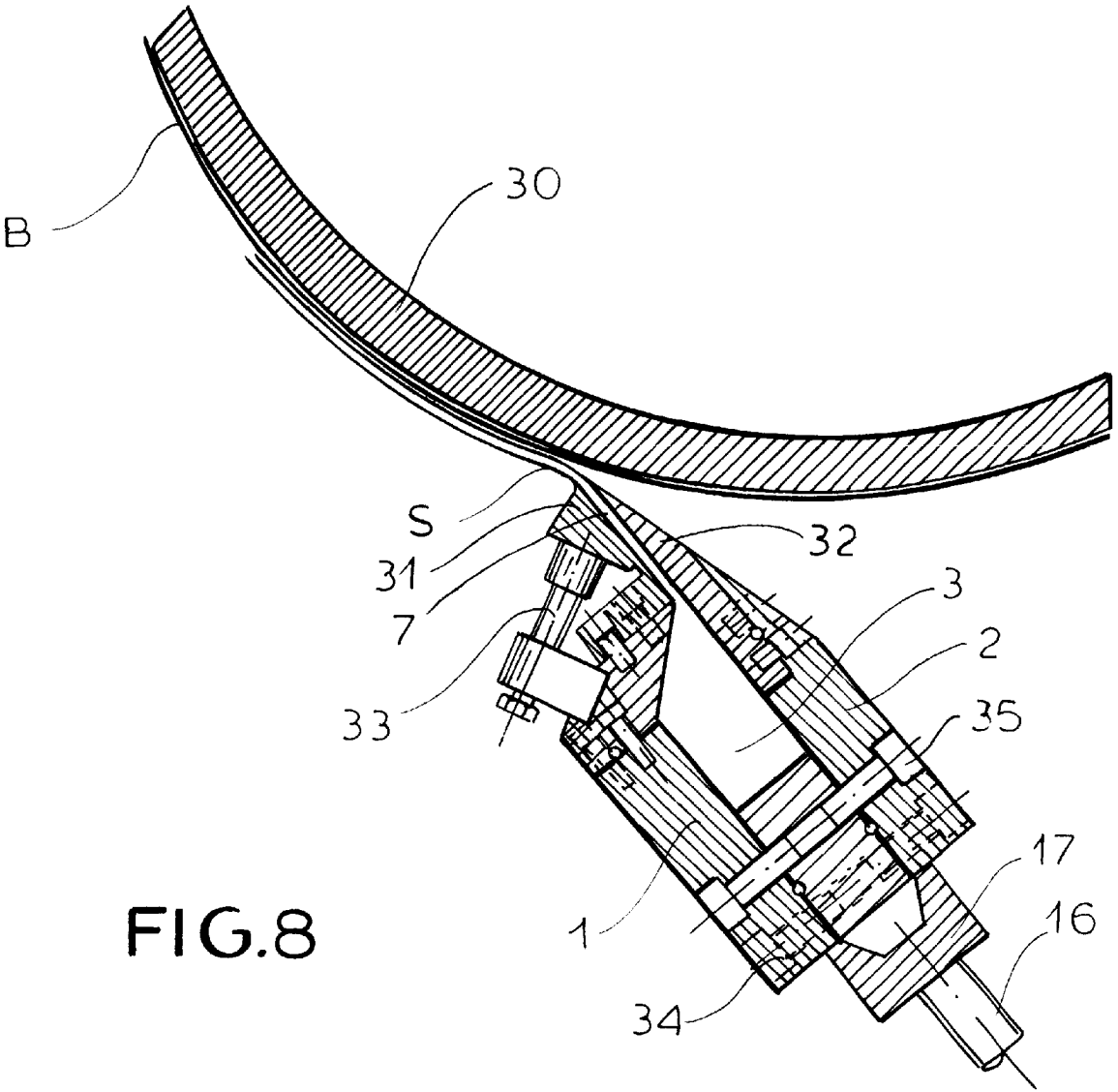
FIG. 8 is a cross section of an alternate embodiment of a slot nozzle designed as a free jet nozzle.

FIG. 8 shows the cross section of a slot nozzle used as free jet nozzle, by means of which coating paint is applied on a paper or cardboard web B supported by a mating roll 30.

Also when used as a free jet nozzle, the slot nozzle has a slot-shaped outlet channel 7 extending over the work width. The slot-shaped outlet channel 7 is bordered by two lips 31, 32, one of which—in the embodiment example the outlet side lip 31—via adjustment elements 33 can set various distances from the other lip 32 by zones, in order to establish a uniform cross section. The width of the outlet channel in the free jet nozzle is set to the already mentioned 700 $\mu$m–1300 $\mu$m.

The distribution chamber 3 is bordered by two side walls 1, 2, which on the incoming side are fastened by screws 35 to a transverse wall 34, from which they are kept at the distance desired for the chamber width. On the outlet side, on each side of wall 1, 2, one of the lips 31, 32 is fastened.

In longitudinal section the construction of the free jet nozzle corresponds basically to the slot nozzle shown in FIGS. 3 and 5. Here also at least two supply channels 16 are connected to the distribution chamber 3, each having a device for setting the volume flow. The connection distance between the supply channels 16 also amounts to 100 mm to 1500 mm, preferably 500 mm to 800 mm. The connection of a supply channel 16 to the distribution chamber 3 is also designed as a diffuser, whereby the diffusers are connected to the distribution chamber 3 inclined in the direction of the lateral border at angles described in the embodiment according to FIGS. 1 to 5.

What is claimed is:

1. A slot nozzle for coating a web of material with a flowable coating substance, said slot nozzle comprising:

a slot-shaped outlet channel extending over the width of the web;

a distribution chamber extending over said width and communicating over said width with said outlet channel;

a plurality of supply conduits connected to said distribution chamber and spaced apart along said distribution chamber and across said width, for supplying the flowable coating substance to said distribution chamber, each of said supply conduits being provided with a device for adjusting a volume flow of the coating substance through the respective conduit to said distribution chamber; and a respective diffuser connecting each of said supply conduits to said distribution chamber and widening in a direction thereof.

2. The slot nozzle defined in claim 1 wherein said distribution chamber is horizontal and wherein said diffusers are each inclined to a vertical toward a lateral side of the distribution chamber.

3. The slot nozzle defined in claim 2 wherein each of said diffusers has a bordering wall adjoining said distribution chamber at an angle $\alpha$ between 0° and 90° and an opposite bordering wall inclined to the distribution chamber at an angle $\beta$ between 10° and 45°.

4. The slot nozzle defined in claim 3 wherein said angle $\alpha$ is between 30° and 60°.

5. The slot nozzle defined in claim 3 wherein the supply conduits are spaced apart along said distribution chamber by distances between 100 mm to 1,500 mm.

6. The slot nozzle defined in claim 5 wherein said distances are between 500 mm and 800 mm.

7. The slot nozzle defined in claim 3 wherein said device is a hose clamp valve for the respective supply conduit.

8. The slot nozzle defined in claim 3, further comprising a row of heating or cooling elements disposed on a longitudinal wall of a nozzle body forming said outlet channel.

9. A slot nozzle for coating a web of material with a flowable coating substance comprising:

a nozzle body forming a slot-shaped outlet channel extending over a width of said web;

a distribution chamber extending over said width and communicating over said width with said outlet channel;

a plurality of supply conduits connected to said distribution chamber and spaced along said distribution chamber across said width of said web; and a respective device for each supply conduit for adjusting a volume flow of said coating substance through the respective supply conduit to the distribution chamber, said nozzle body being composed of two parts, each having a surface ground inner surface, said distribution chamber being formed as a groove in one of said parts, a flat member being inserted between said inner surfaces of said parts above said distribution chamber for maintaining a gap between said surfaces below said distribution chamber to form said outlet channel.

10. The slot nozzle defined in claim 9 wherein said outlet channel has a slot width of 150 $\mu$m to 600 $\mu$m.

11. The slot nozzle defined in claim 10 wherein said slot width is 250 $\mu$m to 350 $\mu$m.

12. The slot nozzle defined in claim 9 wherein said distribution chamber has a height of 10 mm to 100 mm.

13. The slot nozzle defined in claim 12 wherein said height is 20 mm to 60 mm.

14. The slot nozzle defined in claim 9, further comprising a diffuser connecting each of said supply conduits to the distribution chamber and widening in the direction of the distribution chamber.

* * * * *